United States Patent [19]

Bourgeois et al.

[11] 4,162,386

[45] Jul. 24, 1979

[54] METHOD OF AND MEANS FOR SECURING AN ELECTRIC SWITCH OPERATING LEVER IN A ONE-HOLE MOUNTING BUSHING

[75] Inventors: James E. Bourgeois; Leonardus J. Josemans, both of Smithfield, N.C.

[73] Assignee: Cutler-Hammer, Inc., Milwaukee, Wis.

[21] Appl. No.: 849,335

[22] Filed: Nov. 7, 1977

[51] Int. Cl.[2] ..... H01H 03/04

[52] U.S. Cl. ..... 200/339; 403/122; 74/523; 200/67 G

[58] Field of Search ..... 200/67 G, 329, 339; 29/513, 505, 506, 516, 517, 622; 74/523; 403/113, 114, 122

[56] References Cited

U.S. PATENT DOCUMENTS

| | | | |
|---|---|---|---|
| 1,708,040 | 4/1929 | Zerk | 29/513 X |
| 1,736,849 | 11/1929 | Douglas | 74/523 |
| 2,530,554 | 11/1950 | Tinnerman | 403/122 |
| 3,582,584 | 6/1971 | Best | 200/339 X |
| 3,604,286 | 9/1971 | Foreman | 200/339 X |
| 3,604,868 | 9/1971 | Batcheller et al. | 200/339 X |
| 3,858,012 | 12/1974 | Lockard | 200/339 X |

*Primary Examiner*—Herbert F. Ross

*Attorney, Agent, or Firm*—Hugh R. Rather; William A. Autio; Michael E. Taken

[57] ABSTRACT

A method of and means for securing a toggle type operating lever in place in an electric switch or the like. The lever is provided with integral trunnions that are fitted into pivot sockets formed internally in a switch mounting bushing. Tab portions partially sheared out the bushing wall are bent inwardly to underlie the pivot trunnions to retain the latter in place.

3 Claims, 3 Drawing Figures

METHOD OF AND MEANS FOR SECURING AN ELECTRIC SWITCH OPERATING LEVER IN A ONE-HOLE MOUNTING BUSHING

PRIOR ART

Lever operated switches of the one-hole mounting type commonly have their operating levers pivotally supported on a pivot pin that is transversely mounted across the mounting bushing. Other forms utilize levers having integral pivot trunnions which are held in bushing pivot sockets by separate retaining inserts or the like emplaced in the mounting bushing.

SUMMARY OF THE INVENTION

It is a primary object of the invention to provide an improved method of and means for pivotally mounting and securing the operating lever of an electric switch in place in a mounting bushing.

A more specific object is to provide such a method and means which is characterized by providing integral pivot socket means within a one-hole mounting bushing and by shearing and bending portions of such bushing to secure the operating lever in place.

Other objects and advantages of the invention will hereinafter appear.

DESCRIPTION OF THE PREFERRED EMBODIMENT

Figure 1:
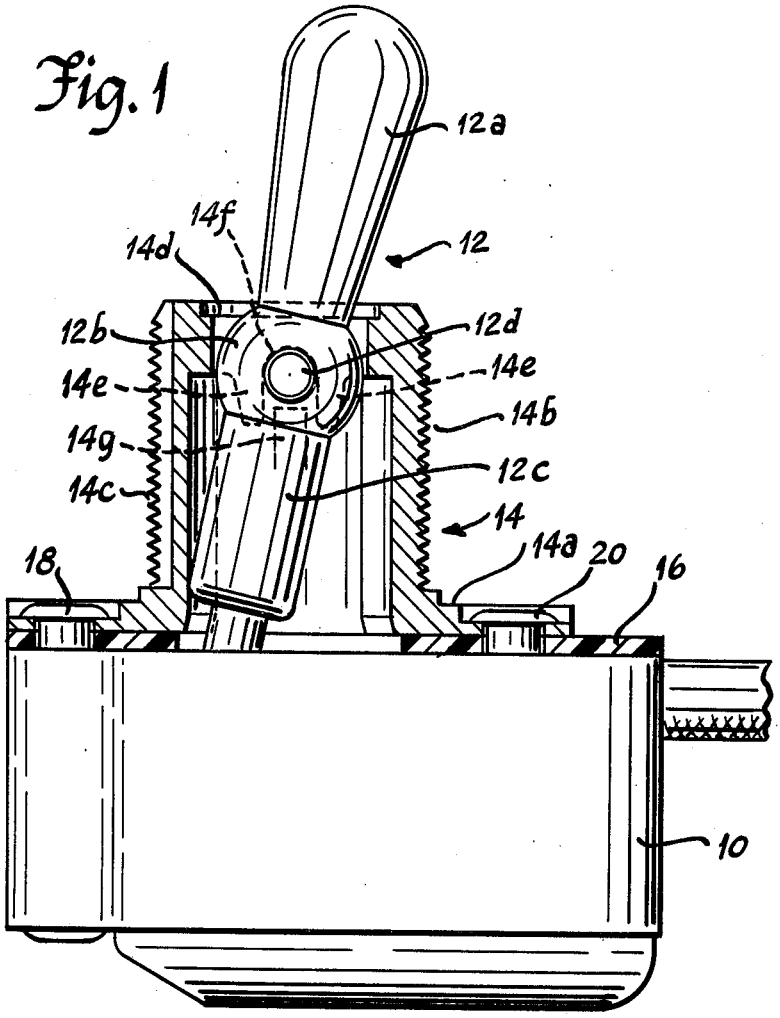
FIG. 1 is an elevational view, partially in longitudinal cross section of an electric switch incorporating the invention.

The electric switch shown in the drawing generally comprises a housing 10, a toggle lever 12, a combined bushing and partial cover member 14, and an insulating member 16 which lies between the upper end of the housing 10 and the rectangular base portion **14*a* of member 14. Housing 10, member 14 and member 16 are secured together by rivets 18 and 20** which may be assumed to extend through aligned openings formed in those members.

The present invention relates solely to the method and means of pivotally mounting and securing lever 12 within the bushing portion **14*b* of member 14**. Consequently detailed description of other parts of the switch will be dispensed with for the sake of clarity.

Lever 12 is provided with an external handle portion **12*a*, an integral semi-cylindrical portion 12*b*, and an internal stem portion 12*c* which may be assumed to engage with an internal operating mechanism (not shown) within the housing 10. Lever 12 is also provided with pivot trunnion portions 12*d* which are integral with and extend in aligned relation from opposite sides of the portion 12*b***.

The member 14 in a preferred form is made of die cast metal and provided with external threads **14*c* to facilitate its securement in panel openings by use of securing nuts. Adjacent the outer end of bushing 14*b* there is provided an inner annular shoulder 14*d*. Integrally formed, parallel tangs 14*e* extend downwardly from the shoulder 14*d* on opposite sides within the main bushing cavity. At the upper ends of each pair the tangs 14*e* are integral U-shaped sockets 14*f* which provide pivot bearings for the trunnion portions 12*d* of lever 12**.

In assembling lever 12 to the bushing **14*b*, the handle 12*a* is inserted through the bottom of the main bushing cavity and through the opening in the shoulder 14*d*. The trunnions 12*d* are then oriented between respective pairs of the tangs 14*e* and seated in the sockets 14*f*. The partial assembly is then inverted so that the end of the handle 12*a* of the lever extends downwardly and the trunnion 12*d* are held in the sockets 14*f*** under gravity.

Figure 2:
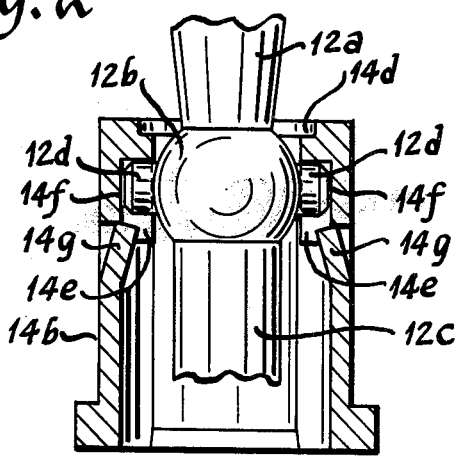
FIG. 2 is a view in transverse cross section of a portion of a part shown in FIG. 1.
Figure 3:
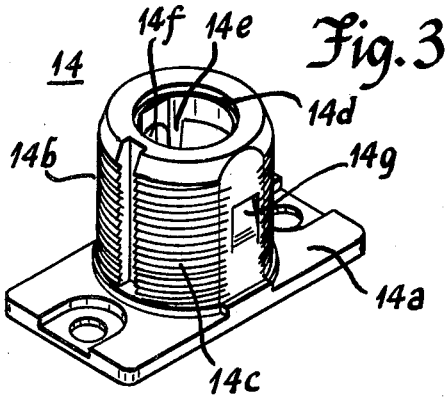
FIG. 3 is a perspective view of the part shown in FIGS. 1 and 2.

Suitable combination shearing and bending tools are then moved in against the bushing **14*b* in line with, but above the ends of the trunnions 12*d* on opposite sides of the bushing. Preferably the shearing tool portions are designed to shear through the wall of bushing 14*b* to provide integral rectangular tabs 14*g* which are separated on three sides from the bushing wall during the initial inward movement. Then during the final inward movement punch portions are moved in against each of the tabs 14*g*** to bend the latter inwardly of the main bushing cavity to the positions shown in FIG. 2.

With assembly of lever 12 in bushing **14*b* as aforedescribed it will be seen that lever 12 is free to pivot in one plane and is restrained against any appreciable inward or outward movement by the sockets 14*f* and the pressed-in tabs 14*g***. It will be seen that this method and means of mounting a pivotal switch operating lever eliminates separate pivot pins, thereby reducing cost and labor.

We claim:

1. In an electric switch or the like having a unitary one-hole mounting bushing and a toggle operating lever, the improvement comprising, providing said lever with oppositely disposed aligned pivot trunnions, providing bearing socket means internally of said bushing in which said lever trunnions seat and said lever is thereby constrained for pivotal movement in one plane, and diametrically opposed portions of the side wall of said bushing sheared through and bent inwardly of said side wall to underlie said pivot trunnions of said lever to thereby restrain the latter against withdrawal from said bearing socket means.

2. The improvement according to claim 1 wherein said bearing socket means comprises integral pairs of spaced parallel tangs formed to provide substantially U-shaped bearing sockets.

3. The method of securing a switch operating lever for pivotal bearing support in a unitary one-hole type mounting bushing, the steps comprising:

a. providing a mounting bushing with diametrically opposed internal U-shaped bearing sockets and an operating lever having aligned pivot trunnions on opposite sides thereof, then b. inserting said lever into said bushing and seating said trunnions in said bushing bearing sockets, then c. shearing through diametrically opposed side wall portion of said bushing to constrain pivotal movement of said lever in one plane to provide tab portions which underlie each of said trunnions below the open ends of said sockets, and d. pressing each of said tabs inwardly of said bushing side wall to positions underlying portions of said lever trunnions to thereby prevent withdrawal of the latter from said bearing sockets.

* * * * *